US010673139B2

(12) United States Patent
Long et al.

(10) Patent No.: US 10,673,139 B2
(45) Date of Patent: Jun. 2, 2020

(54) PHASED ARRAY SYSTEM AND BEAM SCANNING METHOD

(71) Applicant: Huawei Technologies Co., Ltd., Shenzhen (CN)

(72) Inventors: Hao Long, Madrid (ES); Fusheng Tang, Shenzhen (CN); Yanxing Luo, Chengdu (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 270 days.

(21) Appl. No.: 15/856,700

(22) Filed: Dec. 28, 2017

(65) Prior Publication Data

US 2018/0123239 A1 May 3, 2018

Related U.S. Application Data

(63) Continuation of application No. PCT/CN2015/082620, filed on Jun. 29, 2015.

(51) Int. Cl.

| | |
|---|---|
| ***H01Q 3/28*** | (2006.01) |
| ***H01Q 3/36*** | (2006.01) |
| ***H01Q 21/08*** | (2006.01) |
| ***H01Q 3/30*** | (2006.01) |
| ***H01Q 3/26*** | (2006.01) |

(52) U.S. Cl.

CPC ..... *H01Q 3/28* (2013.01); *H01Q 3/2605* (2013.01); *H01Q 3/30* (2013.01); *H01Q 3/36* (2013.01); *H01Q 21/08* (2013.01)

(58) Field of Classification Search

CPC combination set(s) only.

See application file for complete search history.

(56) References Cited

U.S. PATENT DOCUMENTS

2005/0285785 A1* 12/2005 Martin ..... H01Q 3/2611 342/372

2006/0125687 A1 6/2006 Greeley (Continued)

FOREIGN PATENT DOCUMENTS

CN 101218710 A 7/2008

CN 101359777 A 2/2009

(Continued)

OTHER PUBLICATIONS

Machine Translation and Abstract of Chinese Publication No. CN101218710, Jul. 9, 2008, 6 pages.

Foreign Communication From a Counterpart Application, Chinese Application No. 201580081058.6, Chinese Office Action dated Apr. 18, 2019, 6 pages.

Machine Translation and Abstract of Chinese Publication No. CN101964448, Feb. 2, 2011, 15 pages.

(Continued)

*Primary Examiner* — Mamadou L Diallo

(74) *Attorney, Agent, or Firm* — Conley Rose, P.C.

(57) ABSTRACT

A phased array system includes at least two traveling wave antennas arranged in parallel, and each traveling wave antenna includes at least two antenna units sequentially connected. A first end of each traveling wave antenna connects to a corresponding first radio frequency channel. The first end of each traveling wave antenna connects to a signal processing module of the phased array system by using the corresponding first radio frequency channel. A phase and/or an amplitude of a signal inputted by the signal processing module from the first end into the traveling wave antenna may be adjusted by adjusting a configuration of the first radio frequency channel.

20 Claims, 9 Drawing Sheets

(56) References Cited

U.S. PATENT DOCUMENTS

| | | | | |
|---|---|---|---|---|
| 2006/0160514 | A1* | 7/2006 | Shoji | H01Q 3/26 455/276.1 |
| 2009/0298421 | A1 | 12/2009 | Andersson et al. | |
| 2010/0036369 | A1 | 2/2010 | Hancock | |
| 2010/0311353 | A1* | 12/2010 | Teillet | H01Q 1/246 455/84 |
| 2011/0310874 | A1* | 12/2011 | Lastinger | H04B 7/0495 370/338 |
| 2012/0235872 | A1 | 9/2012 | Lewis et al. | |
| 2012/0249374 | A1 | 10/2012 | Wang | |
| 2012/0274528 | A1* | 11/2012 | Apostolos | H01Q 13/20 343/785 |
| 2015/0325926 | A1 | 11/2015 | Topak et al. | |
| 2017/0366242 | A1* | 12/2017 | Lee | H01Q 1/243 |

FOREIGN PATENT DOCUMENTS

| | | | |
|---|---|---|---|
| CN | 101964448 | A | 2/2011 |
| CN | 102938503 | A | 2/2013 |
| CN | 104604027 | A | 5/2015 |
| DE | 4331021 | A1 | 3/1995 |
| JP | H02151104 | A | 6/1990 |
| WO | 2005011148 | A1 | 2/2005 |
| WO | 2007026792 | A1 | 3/2007 |

OTHER PUBLICATIONS

Machine Translation and Abstract of Chinese Publication No. CN102938503, Feb. 20, 2013, 10 pages.

Zhou, Y., et al: "A Low Cost Phased Array Antenna Based on Voltage-Controlled Phase Shifter," Radar Science and Technology, vol. 10, No. 2, Apr. 2012, 4 pages.

Foreign Communication From a Counterpart Application, PCT Application No. PCT/CN2015/082620, English Translation of International Search Report dated Apr. 7, 2016, 3 pages.

Foreign Communication From a Counterpart Application, PCT Application No. PCT/CN2015/082620, English Translation of Written Opinion dated Apr. 7, 2016, 6 pages.

Machine Translation and Abstract of German Publication No. DE4331021, Mar. 16, 1995, 5 pages.

Machine Translation and Abstract of International Publication No. WO2007026792, Mar. 8, 2007, 10 pages.

Foreign Communication From a Counterpart Application, European Application No. 15896637.4, Extended European Search Report dated Jun. 12, 2018, 9 pages.

"Smart antenna—Wikipedia", Apr. 7, 2015, XP055608471, 4 pages.

Foreign Communication From a Counterpart Application, European Application No. 15896637.4, European Office Action dated Jul. 31, 2019, 6 pages.

* cited by examiner

PHASED ARRAY SYSTEM AND BEAM SCANNING METHOD

CROSS-REFERENCE TO RELATED APPLICATIONS

This application is a continuation of International Application No. PCT/CN2015/082620, filed on Jun. 29, 2015, the disclosure of which is hereby incorporated by reference in its entirety.

TECHNICAL FIELD

Embodiments of the present disclosure relate to antenna technologies, and in particular, to a phased array system and a beam scanning method.

BACKGROUND

With development of wireless communications technologies, a wireless communications system imposes a higher requirement for antenna performance. An array antenna system can implement spatial electronic scanning of an antenna beam, and therefore is more widely applied to the wireless communications system.

The array antenna system is an antenna system including multiple antenna units arranged according to a rule. A phased array system is an array antenna system that can adjust phases and/or amplitudes of antenna units. Phases and/or amplitudes of signals inputted to the antenna units of the phased array system may be adjusted, so as to change a spatial direction of an antenna beam. In this way, automatic beam tracking upon antenna shaking and automatic alignment of an antenna beam can be implemented by using the phased array system with reference to a control algorithm. Therefore, a deployment time and cost can be greatly reduced by using the phased array system as an antenna of a communications device. In addition, the phased array system can be installed in a location with a poor stability condition such as a street pole due to advantages such as windproof and shakeproof.

In a conventional phased array system, each antenna unit is an independent channel. To implement two-dimensional beam scanning in a horizontal direction and a vertical direction, a corresponding radio frequency channel needs to be configured for each antenna unit. Each radio frequency channel generally includes a phase shifter and/or a variable gain amplifier. Generally, there is an interval of a half wavelength between antenna units to avoid generating a grating lobe. For an array system with m×n antenna units, m×n radio frequency channels are required. However, a relatively large quantity of radio frequency channels causes a complex phased array system, and consequently, power consumption and costs are higher.

By using an antenna unit with an increased gain, a quantity of radio frequency channels and a quantity of phase shifters can be reduced, and therefore complexity of the phased array system can be reduced. However, the antenna unit with the increased gain causes an increased interval. Consequently, a grating lobe occurs in the phased array system, and an application requirement cannot be met.

SUMMARY

Embodiments of the present disclosure provide a phased array system and a beam scanning method, so as to reduce a requirement for a quantity of radio frequency channels while meeting an application requirement for an antenna directivity diagram of the phased array system. Therefore, complexity and costs of the phased array system are reduced.

According to a first aspect, a phased array system is provided, including at least two traveling wave antennas arranged in parallel, where each traveling wave antenna includes at least two antenna units sequentially connected; where a first end of each traveling wave antenna connects to a corresponding first radio frequency channel, the first end of each traveling wave antenna connects to a signal processor of the phased array system by using the corresponding first radio frequency channel, and a phase or an amplitude of a signal inputted by the signal processor from the first end into the traveling wave antenna is adjusted by adjusting a configuration of the first radio frequency channel.

According to a second aspect, a beam scanning method is provided, used for implementing beam scanning of a phased array system, where the phased array system includes at least two traveling wave antennas arranged in parallel, and each traveling wave antenna includes at least two antenna units sequentially connected; a first end of each traveling wave antenna connects to a first radio frequency channel, and the first end of each traveling wave antenna connects to a signal processor of the phased array system by using the corresponding first radio frequency channel; and the method includes controlling the first radio frequency channel corresponding to each traveling wave antenna, to adjust a phase and/or an amplitude of a signal inputted by the signal processor from the first end into the traveling wave antenna, so that a beam of the phased array system points to an expected direction in a dimension perpendicular to a direction of the traveling wave antenna.

According to a third aspect, a beam scanning method is provided, used for implementing beam scanning of a phased array system, where the phased array system includes at least two traveling wave antennas arranged in parallel, and each traveling wave antenna includes at least two antenna units sequentially connected; a first end of each traveling wave antenna connects to a first radio frequency channel, and the first end of each traveling wave antenna connects to a signal processor of the phased array system by using the corresponding first radio frequency channel; a second end of each traveling wave antenna connects to a second radio frequency channel, and the second end of each traveling wave antenna connects to the signal processor by using the corresponding second radio frequency channel; and the method includes controlling the first radio frequency channel and the second radio frequency channel corresponding to each traveling wave antenna, to adjust, by using the first radio frequency channel, a phase and/or an amplitude of a signal inputted by the signal processor from the first end into the traveling wave antenna, and to adjust, by using the second radio frequency channel, a phase and/or an amplitude of a signal inputted by the signal processor from the second end into the traveling wave antenna, so that a beam of the phased array system points to an expected direction; where a phase difference and/or an amplitude difference between the first ends of the traveling wave antennas, and a phase difference and/or an amplitude difference between the second ends of the traveling wave antennas are/is used to control a direction that is of a beam of the phased array system and that is in a dimension perpendicular to a direction of the traveling wave antenna; and a phase difference and/or an amplitude difference between the first end and the second end of each traveling wave antenna are/is used to control a direction that is of a beam of the phased array system and that is in a dimension parallel to the direction of the traveling wave antenna.

BRIEF DESCRIPTION OF DRAWINGS

To describe the technical solutions in the embodiments of the present disclosure or in the prior art more clearly, the following briefly describes the accompanying drawings required for describing the embodiments or the prior art. The accompanying drawings in the following description show some embodiments of the present disclosure, and persons of ordinary skill in the art may still derive other drawings from these accompanying drawings without creative efforts.

DESCRIPTION OF EMBODIMENTS

To make the objectives, technical solutions, and advantages of the embodiments of the present disclosure clearer, the following clearly describes the technical solutions in the embodiments of the present disclosure with reference to the accompanying drawings in the embodiments of the present disclosure. The described embodiments are some but not all of the embodiments of the present disclosure. All other embodiments obtained by persons of ordinary skill in the art based on the embodiments of the present disclosure without creative efforts shall fall within the protection scope of the present disclosure.

Figure 1:
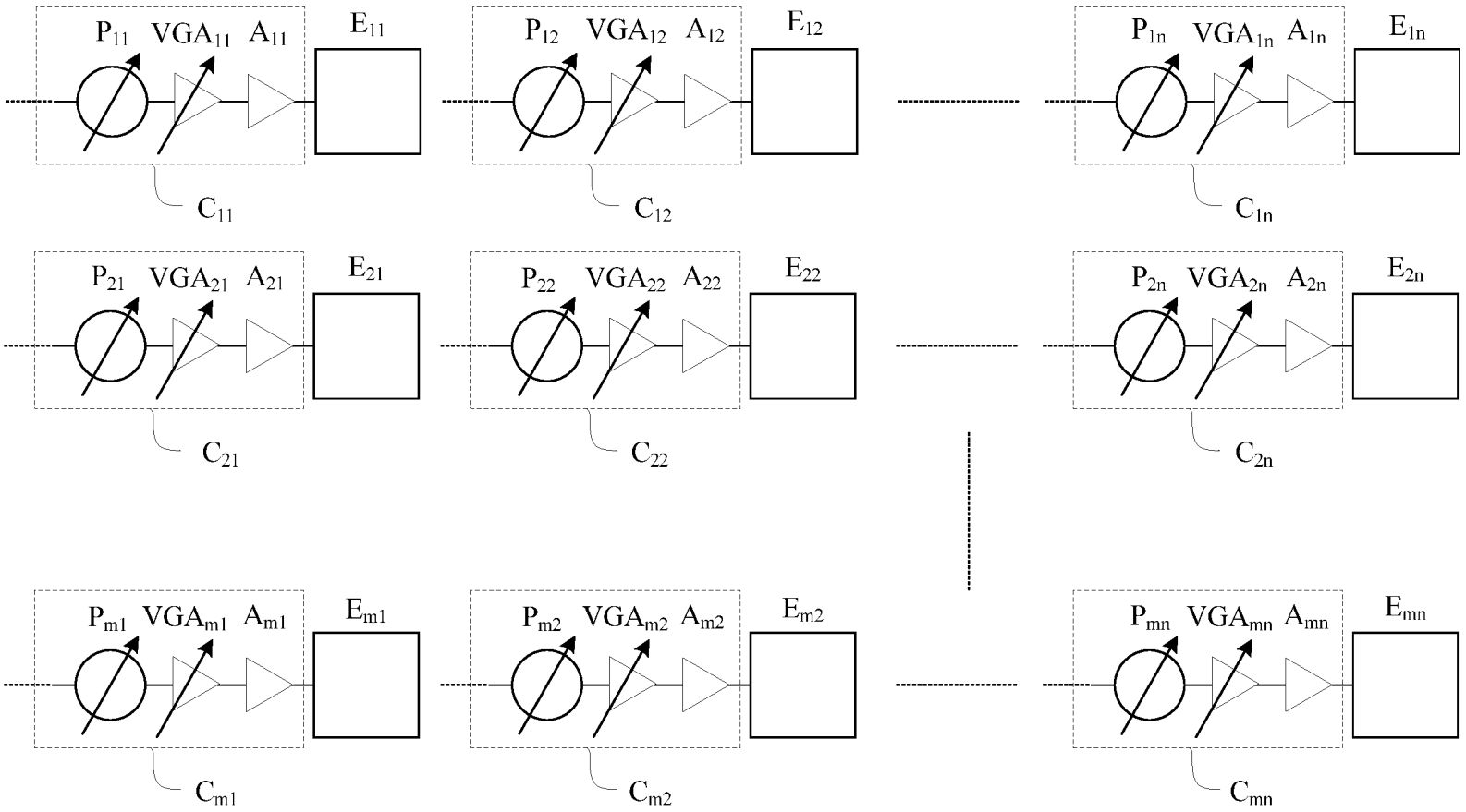
FIG. 1 is a schematic diagram of a conventional phased array system.

FIG. 1 is a schematic diagram of a conventional phased array system. As shown in FIG. 1, the conventional phased array system includes m×n antenna units $E_{mn}$. Each antenna unit $E_{mn}$ connects to a corresponding radio frequency channel $C_{mn}$, and a feeding port of the phased array system connects to each antenna unit $E_{mn}$ by using radio frequency channels $C_{mn}$. There is an interval of a half operating wavelength of the array antenna between antenna units $E_{mn}$.

In the phased array system shown in FIG. 1, each antenna unit $E_{mn}$ is corresponding to one independent radio frequency channel $C_{mn}$, and a phase shifter $P_{mn}$ and a variable gain amplifier $VGA_{mn}$ (which may further include an amplifier $A_{mn}$) that are corresponding to an antenna unit $E_{mn}$ are configured for each radio frequency channel $C_{mn}$. The phase shifter $P_{mn}$ is configured to adjust a phase of an input antenna unit $E_{mn}$, the variable gain amplifier $VGA_{mn}$ is configured to adjust an amplitude of an input antenna unit $E_{mn}$, and the amplifier $A_{mn}$ is configured to further amplify a signal amplitude of an input antenna unit $E_{mn}$. Therefore, beam scanning of the phased array system may be implemented by adjusting a phase of each phase shifter $P_{mn}$ and/or a gain of each variable gain amplifier $VGA_{mn}$. However, each antenna unit $E_{mn}$ connects to one independent radio frequency channel $C_{mn}$. Consequently, complexity and costs of the entire phased array system are relatively high.

To reduce the complexity and costs of the phased array system, an antenna unit with a relatively high gain may be configured for the phased array system, so that a quantity of antenna units in the phased array system may be reduced. In this way, a quantity of antenna channels is reduced, so as to reduce the complexity and costs of the phased array system. However, after the antenna unit with the relatively high gain is used, an interval between antenna units increases. Consequently, a grating lobe and a side lobe in a directivity diagram of the entire phased array system are excessively large; as a result, performance of the phased array system is reduced, and the directivity diagram cannot meet an application requirement.

Figure 2:
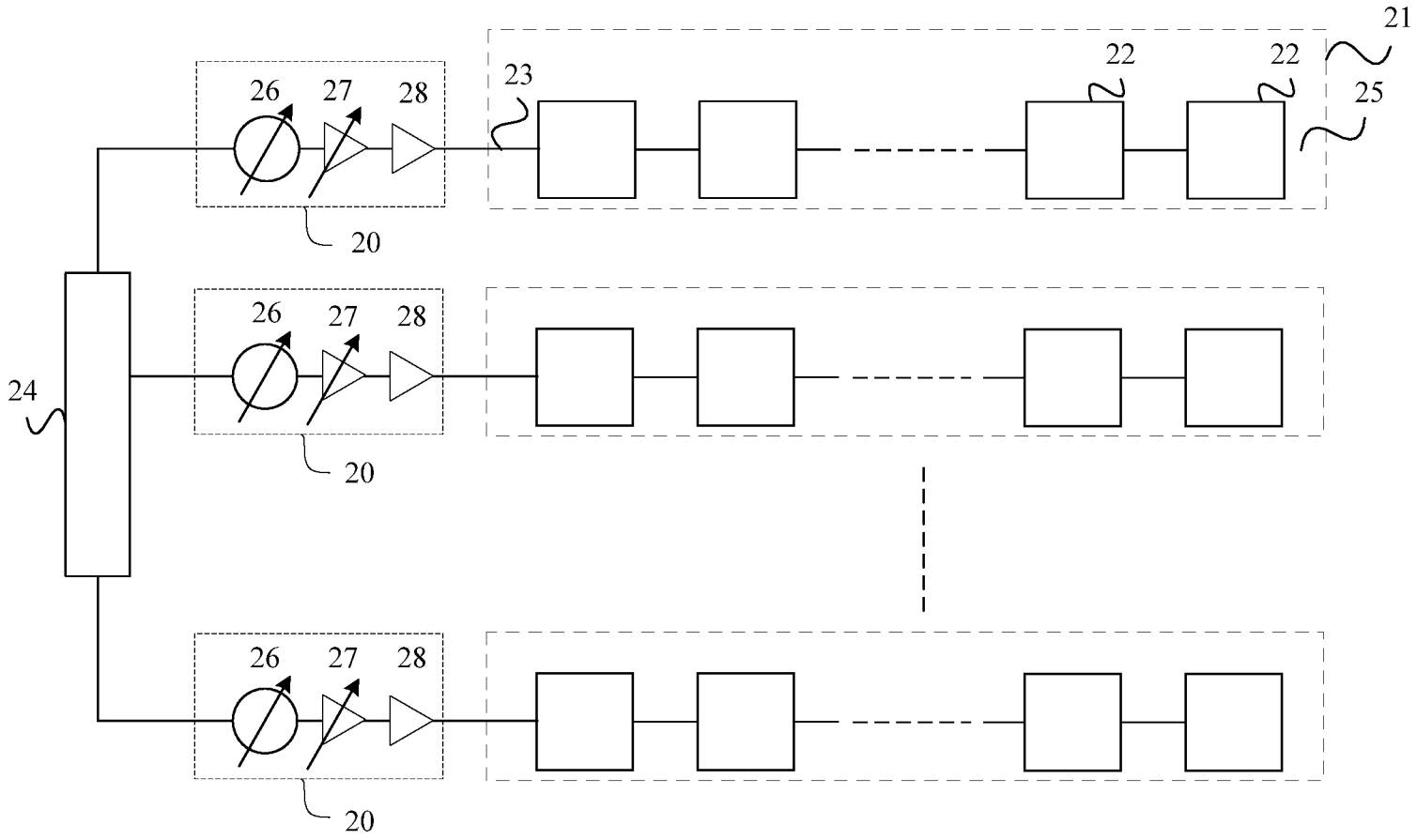
FIG. 2 is a schematic structural diagram of Embodiment 1 of a phased array system according to an embodiment of the present disclosure.

FIG. 2 is a schematic structural diagram of Embodiment 1 of a phased array system according to an embodiment of the present disclosure. As shown in FIG. 2, the phased array system in this embodiment includes at least two traveling wave antennas 21 arranged in parallel. Each traveling wave antenna 21 includes at least two antenna units 22 sequentially connected. A first end 23 of each traveling wave antenna 21 connects to a first radio frequency channel 20, and the first end 23 of each traveling wave antenna 21 connects to a signal processing module 24 of the phased array system by using the first radio frequency channel 20. The signal processing module 24 includes a processing unit such as a modem, configured to combine signals received by traveling wave antennas 21 and convert a combined signal into a baseband signal, or configured to convert a baseband signal into a radio frequency signal and allocate the radio frequency signal to traveling wave antennas 21. A phase and/or an amplitude of a signal inputted by the signal processing module 24 from the first end 23 into the traveling wave antenna 21 may be adjusted by adjusting a configuration of the first radio frequency channel 20. The traveling wave antenna 21 may further include a second end 25.

The most basic traveling wave antenna unit 22 that forms the phased array system shown in FIG. 2 may be basic antenna units in various forms, such as a microstrip antenna, a slot antenna, a dipole antenna, and a waveguide antenna. At least two antenna units 22 are arranged on a transmission line along a transmission line direction and are sequentially connected to form one traveling wave antenna 21. When electromagnetic signals are transmitted in the transmission line direction, some signals are coupled to the antenna units 22 for radiation, and remaining signals continue to be transmitted in the transmission line direction. The signals radiated from the multiple antenna units 22 are combined in space to form a beam, and an expression formula of an amplitude of a signal allocated to each antenna unit 22 is as follows:

$$a_n = \sqrt{1 - |S_{21}, n|^2} \cdot \prod_{i=1}^{n-1} S_{21}, i$$

where n represents a quantity of antenna units 22 on one traveling wave antenna 21, $a_n$ represents a signal amplitude of the $n^{th}$ antenna unit 22 starting from the first end 23 of the traveling wave antenna 21, and $S_{21}$,i represents a transmission function used between both ends of a single antenna unit 22 for a direction from the first end 23 to the second end 25. $S_{21}$,i may be adjusted by adjusting a parameter of each antenna unit 22 and a distance between antenna units 22 of each traveling wave antenna 21. In this way, energy is distributed along the traveling wave antennas 21, so that only a few feeding signals of the first end 23 of the traveling wave antenna 21 arrive at a peer end, and most signals are radiated by using an antenna unit, so as to ensure radiation efficiency of the traveling wave antenna 21.

The first radio frequency channel 20 includes a phase shift unit and/or an amplitude adjustment unit. The phase shift unit is configured to adjust a phase, and the amplitude adjustment unit is configured to adjust an amplitude. The phase and/or the amplitude of the signal inputted by the signal processing module 24 from the first end 23 into the traveling wave antenna 21 may be adjusted by adjusting a configuration of the phase shift unit and/or the amplitude adjustment unit. In this embodiment, a first phase shifter 26 is used as the phase shift unit, and a first variable gain amplifier 27 and a first power amplifier 28 are used as the amplitude adjustment unit. It should be noted that the first power amplifier 28 is disposed for further amplifying a signal, and the first power amplifier 28 is not necessarily disposed.

The first phase shifter 26 is configured to adjust the phase of the signal inputted by the signal processing module 24 from the first end 23 into the traveling wave antenna 21. For traveling wave antennas 21, a phase difference between the first ends 23 of the traveling wave antennas 21 in the phased array system may be adjusted by adjusting a parameter (that is, a phase shift value) of the first phase shifter 26, so that an angle of a radiation beam in a dimension perpendicular to a direction of the traveling wave antenna 21 is adjusted.

Optionally, the first end 23 of each traveling wave antenna 21 may further connect to the first variable gain amplifier 27. The first variable gain amplifier 27 is configured to adjust the amplitude of the signal inputted by the signal processing module 24 from the first end 23 into the traveling wave antenna 21. An amplitude of a signal fed from the first end 23 into antenna units 22 of the traveling wave antenna 21 may be adjusted by adjusting a parameter (that is, amplifying a gain) of the first variable gain amplifier 27. Further, the first end 23 of each traveling wave antenna 21 may further connect to the first power amplifier 28. The first power amplifier 28 is generally a power amplifier. Generally, a signal inputted from the first end 23 into the traveling wave antenna 21 is relatively weak. Therefore, the first power amplifier 28 may be disposed, so that the traveling wave antenna 21 can better radiate the signal to the space. An amplitude difference between the first ends 23 of the traveling wave antennas 21 in the phased array system may be adjusted, so that the angle of the radiation beam in the dimension perpendicular to the direction of the traveling wave antennas 21 can be adjusted. Both the first phase shifter 26 and the first variable gain amplifier 27 (the first power amplifier 28) may be disposed, that is, both a phase and an amplitude may be adjusted.

The first phase shifter 26, the first variable gain amplifier 27, and the first power amplifier 28 together form the first radio frequency channel 20 of the traveling wave antenna 21. Each traveling wave antenna 21 is corresponding to a first radio frequency channel 20.

The at least two traveling wave antennas 21 are arranged in parallel, to form the phased array system. The first end 23 of each traveling wave antenna 21 connects to the signal processing module 24 of the phased array system by using the first radio frequency channel 20. The first radio frequency channel 20 completes signal phase and/or amplitude conversion between the traveling wave antenna 21 and the signal processing module 24.

Directivity diagrams of radiation signals of the traveling wave antennas 21 are combined into a directivity diagram of the entire phased array system. A parameter of the first phase shifter 26 and/or the first variable gain amplifier 27 that connect to each traveling wave antenna 21 may be adjusted, so that a phase difference between traveling wave antennas 21 can be changed, and the angle of the radiation beam that is of the phased array system and that is in the dimension perpendicular to the direction of each traveling wave antenna 21 can be adjusted, that is, a vertical beam angle of the phased array system, so as to implement beam scanning in a vertical direction.

In the phased array system provided in this embodiment, the first radio frequency channel 20 is disposed only at the first end 23 of each traveling wave antenna 21, provided that spatial beam scanning is implemented in the vertical direction. Therefore, in the phased array system provided in this embodiment, a radio frequency channel is unnecessarily configured for each antenna unit 22, thereby reducing a quantity of radio frequency channels. In addition, in the phased array system provided in this embodiment, a basic antenna unit 22 instead of an antenna unit with a higher gain is used as a radiation resource. Therefore, the directivity diagram of the phased array system is not affected. If a quantity of antenna units 22 in the phased array system provided in this embodiment is the same as that in the phased array system shown in FIG. 1, and is m×n, in the phased array system provided in this embodiment, only m radio frequency channels are required to implement spatial beam scanning of the phased array system in the vertical direction, and this greatly reduces a quantity of radio frequency channels.

According to the phased array system provided in this embodiment, at least two traveling wave antennas arranged in parallel are disposed, each traveling wave antenna includes at least two antenna units sequentially connected, and a first end of each traveling wave antenna connects to a first radio frequency channel, and connects to a signal processing module by using the first radio frequency channel. Therefore, in the phased array system, a requirement for a quantity of radio frequency channels is reduced while beam scanning is implemented, and therefore complexity and costs of the phased array system are reduced.

Figure 3:
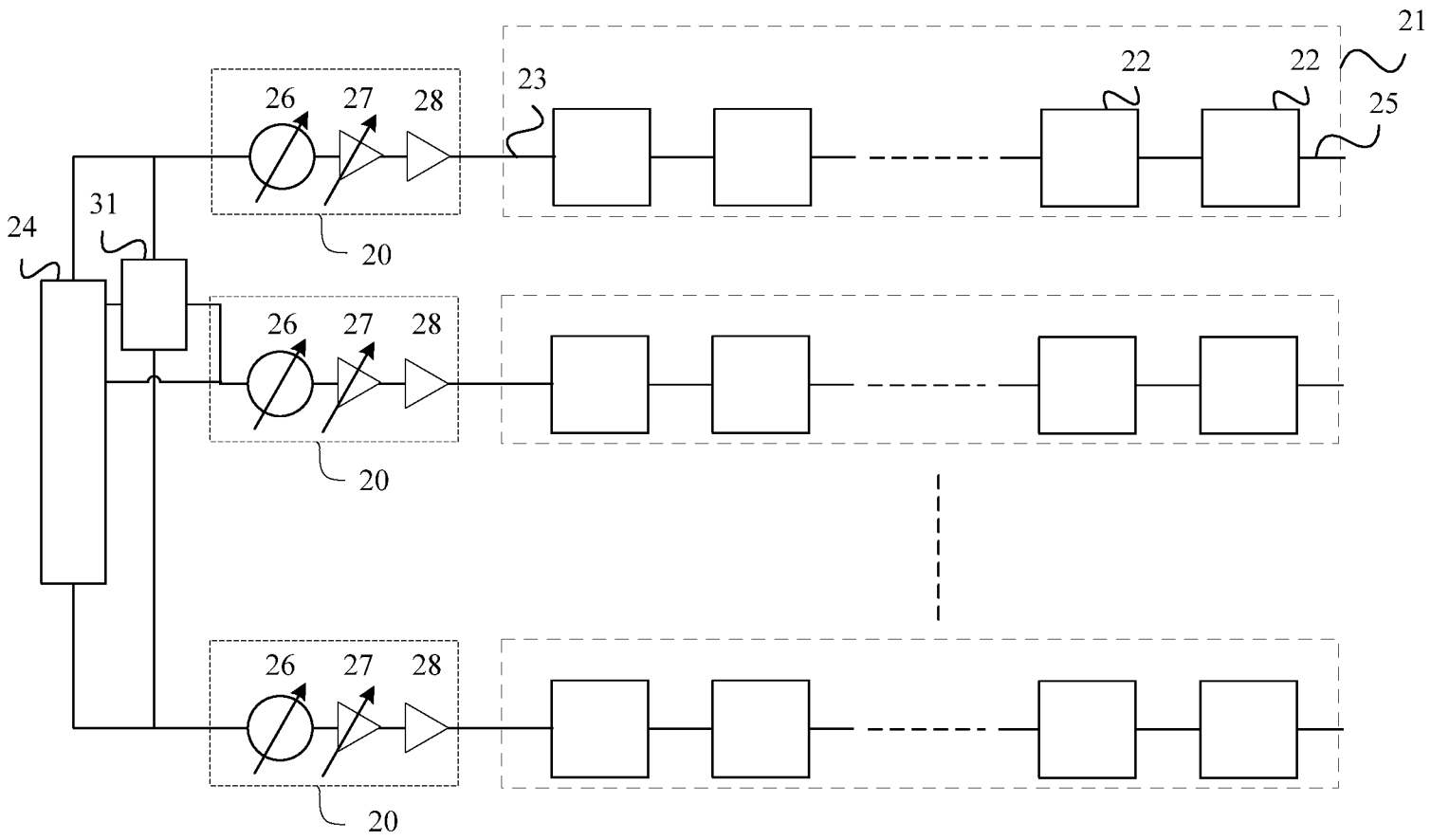
FIG. 3 is a schematic structural diagram of Embodiment 2 of a phased array system according to an embodiment of the present disclosure.

FIG. 3 is a schematic structural diagram of Embodiment 2 of a phased array system according to an embodiment of the present disclosure. As shown in FIG. 3, based on the phased array system shown in FIG. 2, the phased array system in this embodiment further includes a beam control module 31. A first end of the beam control module 31 connects to the signal processing module 24, and a second end of the beam control module 31 connects to each first radio frequency channel 20. The beam control module 31 includes an arrival estimation module and a beam configuration module. The arrival estimation module is configured to determine a direction of arrival, and the beam configuration module is configured to adjust a phase and/or an amplitude of an input signal of the traveling wave antenna 21. Herein, the beam configuration module configures a parameter of the first phase shifter 26 and/or the first variable gain amplifier 27 of each first radio frequency channel 20 to adjust the phase and/or the amplitude of the input signal of the traveling wave antenna 21.

The beam control module 31 is configured to control the first radio frequency channel 20 corresponding to each traveling wave antenna 21, to adjust, by using the first radio frequency channel 20, the phase and/or the amplitude of the signal inputted by the signal processing module 24 from the first end 23 into the traveling wave antenna 21.

That is, the beam control module 31 is configured to control a beam direction of an array antenna. The beam control module 31 obtains current information about the direction of arrival by using the arrival estimation module, and uses the current information about the direction of arrival as a basis for phase and amplitude adjustments, and the beam control module 31 adjusts, by using the beam configuration module, a phase shift unit and/or an amplitude adjustment unit of the first radio frequency channel 20 corresponding to each traveling wave antenna 21 to control the phase and/or the amplitude.

Figure 4:
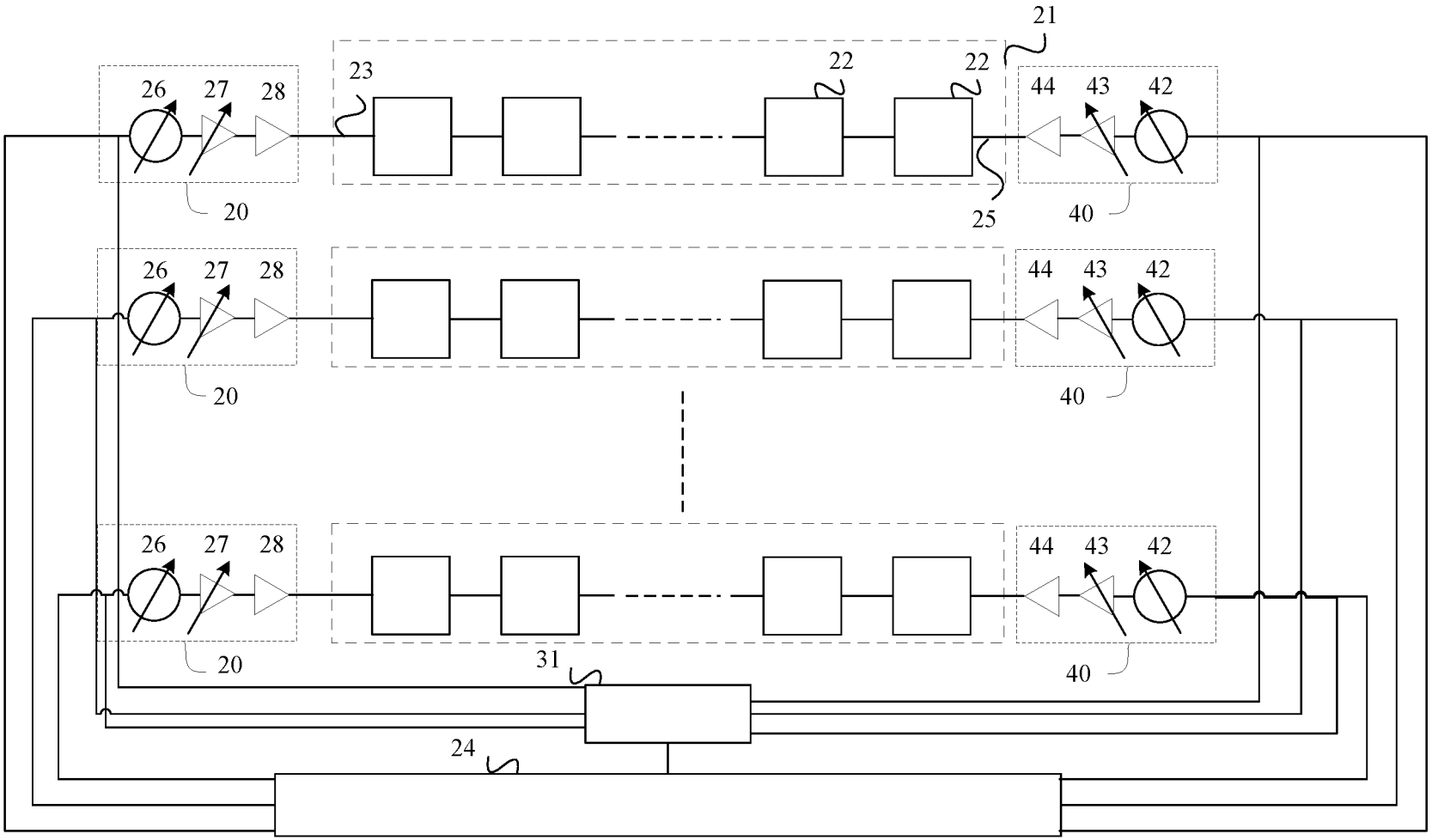
FIG. 4 is a schematic structural diagram of Embodiment 3 of a phased array system according to an embodiment of the present disclosure.

FIG. 4 is a schematic structural diagram of Embodiment 3 of a phased array system according to an embodiment of the present disclosure. As shown in FIG. 4, based on the phased array system shown in FIG. 3, in the phased array system in this embodiment, the second end 25 of each traveling wave antenna 21 further connects to a second radio frequency channel 40. The second end 25 of each traveling wave antenna 21 connects to the signal processing module 24 of the phased array system by using the corresponding second radio frequency channel 40. The signal processing module 24 includes a processing unit such as a modem, configured to combine signals received by traveling wave antennas 21 and convert a combined signal into a baseband signal, or configured to convert a baseband signal into a radio frequency signal and allocate the radio frequency signal to traveling wave antennas 21. The beam control module 31 includes the arrival estimation module and the beam configuration module. The arrival estimation module is configured to determine a direction of arrival, and the beam configuration module is configured to adjust a phase and/or an amplitude of an input signal of the traveling wave antenna 21. A phase and/or an amplitude of a signal inputted by the signal processing module 24 from the second end 25 into the traveling wave antenna 21 may be adjusted by adjusting a configuration of the second radio frequency channel 40.

The second radio frequency channel 40 includes a phase shift unit and/or an amplitude adjustment unit. The phase shift unit is configured to adjust a phase, and the amplitude adjustment unit is configured to adjust an amplitude. Therefore, the phase and/or the amplitude of the signal inputted by the signal processing module 24 from the second end 25 into the traveling wave antenna 21 may be adjusted by adjusting a configuration of the phase shift unit and/or the amplitude adjustment unit. In this embodiment, a second phase shifter 42 is used as the phase shift unit, and a second variable gain amplifier 43 and a second power amplifier 44 are used as the amplitude adjustment units. It should be noted that the second power amplifier 44 is disposed for further amplifying a signal, and the second power amplifier 44 is not necessarily disposed.

The second phase shifter 42 is configured to adjust the phase of the signal inputted by the signal processing module 24 from the second end 25 into the traveling wave antenna 21. For each traveling wave antenna 21, a phase difference between the first end 23 and the second end 25 of each traveling wave antenna 21 in the phased array system may be adjusted by adjusting the parameter (that is, the phase shift value) of the first phase shifter 26 and that of the second phase shifter 42, so that an angle of a radiation beam in a dimension parallel to a direction of the traveling wave antenna 21 is adjusted.

Optionally, the second end 25 of each traveling wave antenna 21 may further connect to the second variable gain amplifier 43. The second variable gain amplifier 43 is configured to adjust the amplitude of the signal inputted by the signal processing module 24 from the second end 25 into the traveling wave antenna 21. An amplitude difference of a signal of antenna units 22 fed from the first end 23 and the second end 25 of the traveling wave antenna 21 may be adjusted by adjusting parameters (that is, amplifying a gain) of a first variable gain amplifier 27 and the second variable gain amplifier 43. Further, the second end 25 of each traveling wave antenna 21 may further connect to the second power amplifier 44. The second power amplifier 44 is generally a power amplifier. Generally, a signal inputted from the second end 25 into the traveling wave antenna 21 is relatively weak. Therefore, the second power amplifier 44 may be disposed, so that the traveling wave antenna 21 can better radiate the signal to space. An amplitude difference between the first end 23 and the second end 25 of each traveling wave antenna 21 in the phased array system may be adjusted, so that the angle of the radiation beam in the dimension parallel to the direction of the traveling wave antenna 21 can be adjusted. Both the second phase shifter 42 and the second variable gain amplifier 43 (the second power amplifier 44) may be disposed, that is, both a phase and an amplitude may be adjusted.

The second phase shifter 42, the second variable gain amplifier 43, and the second power amplifier 44 together form the second radio frequency channel 40 of the traveling wave antenna 21. Each traveling wave antenna 21 is corresponding to a second radio frequency channel 40.

Radio frequency channels are disposed at the first end 23 and the second end 25 of each traveling wave antenna 21, so that phases and/or amplitudes of signals fed from both the first end 23 and the second end 25 into the traveling wave antenna 21 can be controlled. Parameters of the first radio frequency channel 20 and the second radio frequency channel 40 that connect to each traveling wave antenna 21 may be adjusted, so that the phase difference and/or amplitude difference between the first end 23 and the second end 25 of different traveling wave antennas 21 can be changed, and the angle of the radiation beam that is of the phased array system and that is in the dimension parallel to the direction of each traveling wave antenna 21, that is, a horizontal beam angle of the phased array system, can be adjusted, so as to implement beam scanning in a horizontal direction.

When both the first radio frequency channel 20 and the second radio frequency channel 40 are configured for each traveling wave antenna 21, parameters of the first phase shifter 26 and/or the first variable gain amplifier 27 and the second phase shifter 42 and/or the second variable gain amplifier 43 are adjusted, so that beam scanning in the phased array system can be implemented both in the horizontal direction and in the vertical direction, that is, spatial beam scanning of the phased array system can be implemented.

In the phased array system in the embodiment shown in FIG. 4, each traveling wave antenna 21 connects to one first radio frequency channel 20 and one second radio frequency channel 40. That is, one traveling wave antenna 21 is corresponding two radio frequency channels. Therefore, a total quantity of radio frequency channels required for the entire phased array system is twice a quantity of traveling wave antennas 21. Provided that a quantity of antenna units 22 in each traveling wave antenna 21 is greater than two, fewer radio frequency channels are used in the phased array system provided in this embodiment than those in the phased array system in the embodiment shown in FIG. 1, and therefore complexity and costs of the phased array system are reduced. Generally, to improve a beam in the phased array system, each traveling wave antenna 21 has at least three antenna units 22. Therefore, in the phased array system provided in this embodiment, the complexity and costs of the phased array system are reduced while spatial beam scanning is implemented.

Further, in the embodiment shown in FIG. 4, the first end of the beam control module 31 connects to the signal processing module 24, and the second end of the beam control module 31 connects to each second radio frequency channel 40.

The beam control module 31 is configured to control the second radio frequency channel 40 corresponding to each traveling wave antenna 21, to adjust, by using the second radio frequency channel 40, the phase and/or the amplitude of the signal inputted by the signal processing module 24 from the second end 25 into the traveling wave antenna 21. Herein, the beam configuration module configures a parameter of the second phase shifter 42 and/or the second variable gain amplifier 43 of each second radio frequency channel 40 to adjust the phase and/or the amplitude of the input signal of the traveling wave antenna 21.

That is, the beam control module 31 is configured to control a beam direction of an array antenna. The beam control module 31 obtains current information about a direction of arrival by using the arrival estimation module, and uses the current information about the direction of arrival as a basis for phase and amplitude adjustments, and the beam control module 31 adjusts, by using the beam configuration module, the phase shift units and/or the amplitude adjustment units of the first radio frequency channel 20 and the second radio frequency channel 40 corresponding to each traveling wave antenna 21, to control the phases and/or the amplitudes inputted from both the first end 23 and the second end 25 of the traveling wave antenna 21.

In the embodiments shown in FIG. 2 to FIG. 4, there may be an arbitrary interval between the at least two antenna units 22 of each traveling wave antenna 21, provided that the radiation directivity diagram of the entire phased array system meets an actual requirement. Alternatively, the at least two antenna units 22 of each traveling wave antenna 21 may further be disposed at an equal interval. The at least two antenna units 22 of each traveling wave antenna 21 may be disposed at an equal interval, so that a radiation directivity diagram, of each traveling wave antenna 21, on a plane parallel to the traveling wave antenna 21 is optimal, and the radiation directivity diagram of the entire phased array system is optimal. Generally, an interval between two adjacent antenna units of each traveling wave antenna 21 needs to be less than an operating wavelength of the phased array system. It can be learned that from a principle of the phased array system that, when an interval between the antenna units 22 is half of the operating wavelength of the phased array system, a radiation directivity diagram of a phased array system formed by the antenna units 22 is optimal. Therefore, an interval between the at least two antenna units 22 of each traveling wave antenna 21 may be half of the operating wavelength of the phased array system.

In addition, for easier control on the directivity diagram of the phased array system, traveling wave antenna units in each traveling wave antenna array are the same, that is, antenna units in the entire phased array system are the same, so that the radiation directivity diagram of the entire phased array system is optimal and is easily controlled.

Similarly, an interval between two adjacent traveling wave antennas 21 may be less than the operating wavelength of the phased array system. When the interval between the two adjacent traveling wave antennas 21 is half of the operating wavelength of the phased array system, the radiation directivity diagram of the entire phased array system is optimal.

Figure 5:
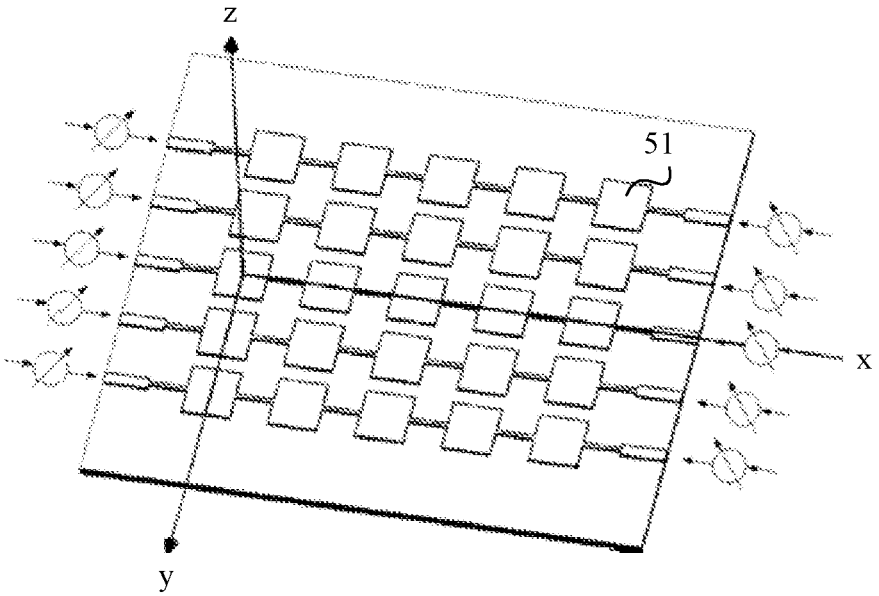
FIG. 5 is a schematic structural diagram of Embodiment 4 of a phased array system according to an embodiment of the present disclosure.
Figure 6A:
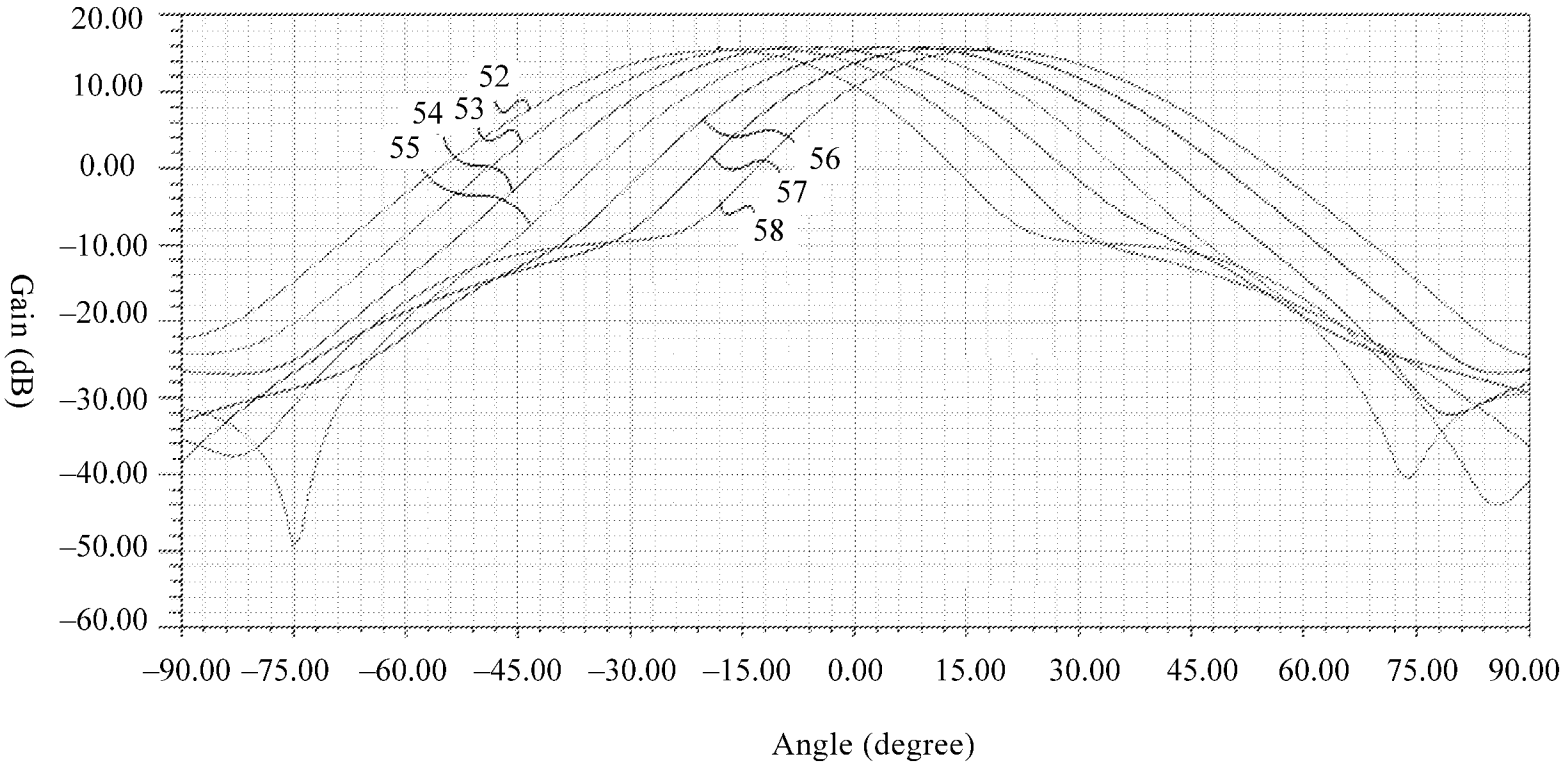
FIG. 6A is a schematic diagram of a simulation result of horizontal-direction scanning of the phased array system shown in FIG. 5.
Figure 6B:
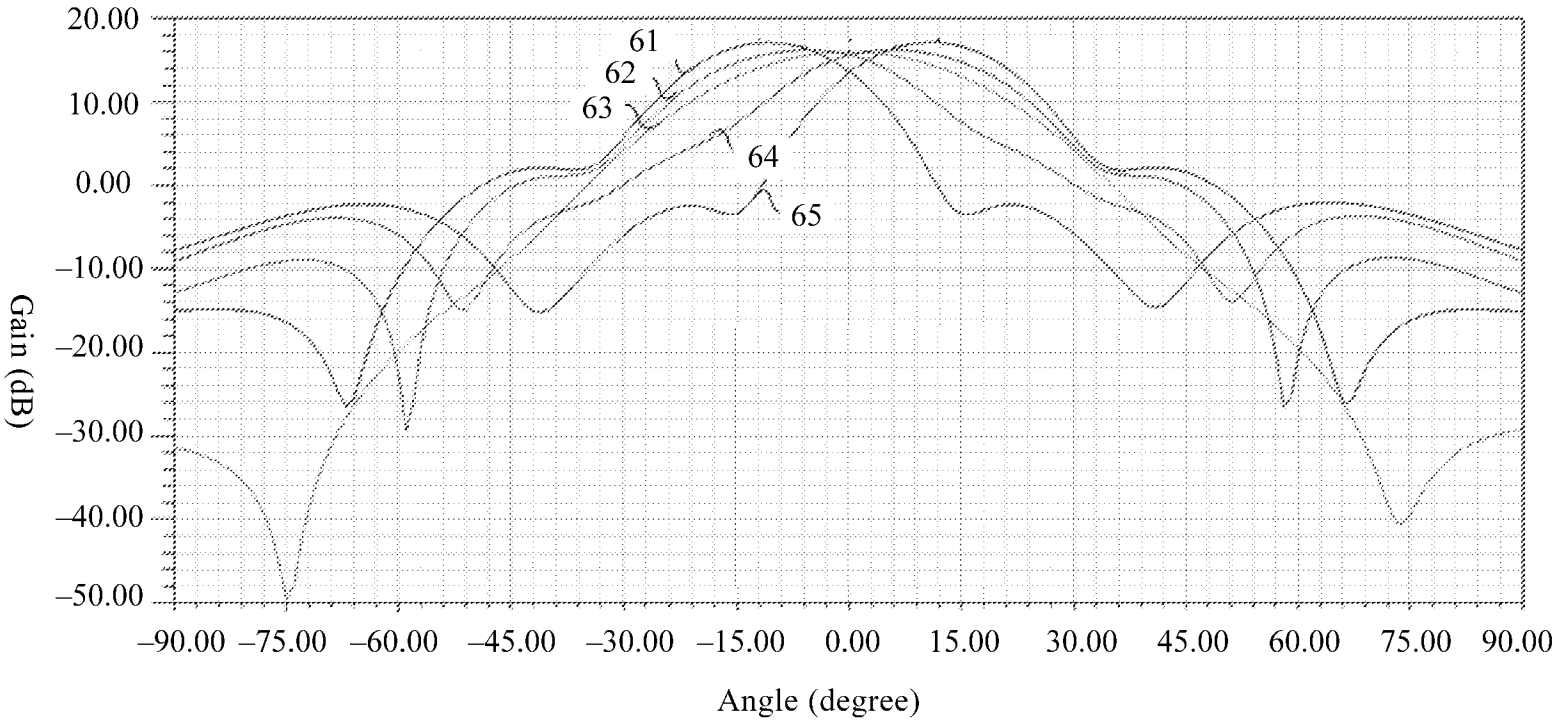
FIG. 6B is a schematic diagram of a simulation result of vertical-direction scanning of the phased array system shown in FIG. 5.

FIG. 5 is a schematic structural diagram of Embodiment 4 of a phased array system according to an embodiment of the present disclosure. As shown in FIG. 5, the phased array system provided in this embodiment is implemented based on a microstrip antenna. The phased array system includes five traveling wave antenna arrays, each traveling wave antenna array includes five antenna units 51, and each antenna unit 51 uses a microstrip antenna design. One phase shifter is disposed at each of both ends of each traveling wave antenna array. It is assumed that a direction along each traveling wave antenna array is a horizontal beam direction (that is, x direction) of the phased array system, and a direction perpendicular to multiple traveling wave antenna arrays is a vertical beam direction (that is, y direction) of the phased array system. FIG. 6A is a schematic diagram of a simulation result of horizontal-direction scanning of the phased array system shown in FIG. 5. FIG. 6B is a schematic diagram of a simulation result of vertical-direction scanning of the phased array system shown in FIG. 5.

In FIG. 6A, a curve 52 to a curve 58 are respectively horizontal directivity diagrams of the phased array system shown in FIG. 5 when a horizontal beam points to −18°, −12°, −6°, 0°, 6°, 12°, and 18°. In FIG. 6B, a curve 61 to a curve 65 are respectively vertical directivity diagrams of the phased array system shown in FIG. 5 when a vertical beam points to −12°, −6°, 0°, 6°, and 12°. In FIG. 6A and FIG. 6B, a vertical coordinate is a gain in a unit of dB, and a horizontal coordinate is an angle in a unit of degree.

It can be learned that, in the phased array system provided in this embodiment of the present disclosure, spatial beam scanning can be implemented, and a quantity of radio frequency channels is reduced.

Figure 7:
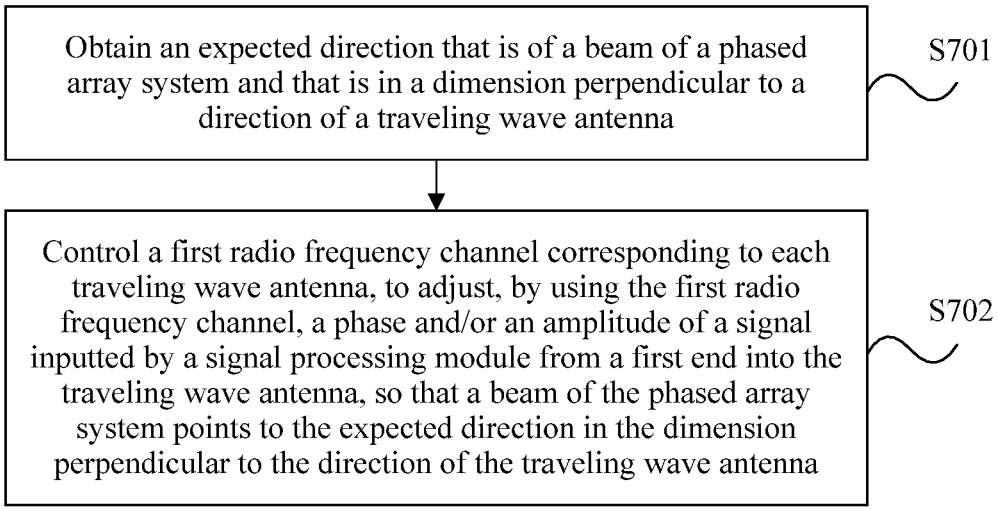
FIG. 7 is a flowchart of Embodiment 1 of a beam scanning method according to an embodiment of the present disclosure.

FIG. 7 is a flowchart of Embodiment 1 of a beam scanning method according to an embodiment of the present disclosure. The method in this embodiment is used for implementing beam scanning of a phased array system. The phased array system includes at least two traveling wave antennas arranged in parallel, and each traveling wave antenna includes at least two antenna units sequentially connected. A first end of each traveling wave antenna connects to a first radio frequency channel, and the first end of each traveling wave antenna connects to a signal processing module of the phased array system by using the corresponding first radio frequency channel.

The method in this embodiment includes the following.

Step S701: Obtain an expected direction that is of a beam of the phased array system and that is in a dimension perpendicular to a direction of the traveling wave antenna.

Step S702: Control the first radio frequency channel corresponding to each traveling wave antenna, to adjust, by using the first radio frequency channel, a phase and/or an amplitude of a signal inputted by the signal processing module from the first end into the traveling wave antenna, so that the beam of the phased array system points to the expected direction in the dimension perpendicular to the direction of the traveling wave antenna.

The beam scanning method provided in this embodiment is used to control beam scanning of the phased array system shown in FIG. 2 or FIG. 3. A specific scanning method is described in the foregoing embodiments in detail, and details are not described herein again. The method in this embodiment may be performed by the beam control module 31 in the embodiment shown in FIG. 3.

Further, in the embodiment shown in FIG. 7, the first radio frequency channel includes a first phase shifter and/or a first variable gain amplifier.

Step S702 includes controlling the first phase shifter corresponding to each traveling wave antenna, to adjust, by using the first phase shifter, the phase of the signal inputted by the signal processing module from the first end into the traveling wave antenna, so that the beam of the phased array system points to the expected direction in the dimension perpendicular to the direction of the traveling wave antenna, and/or controlling the first variable gain amplifier corresponding to each traveling wave antenna, to adjust, by using the first variable gain amplifier, the amplitude of the signal inputted by the signal processing module from the first end into the traveling wave antenna, so that the beam that is of the phased array system and that is perpendicular to the direction of the traveling wave antenna points to the expected direction in the dimension perpendicular to the direction of the traveling wave antenna.

Figure 8:
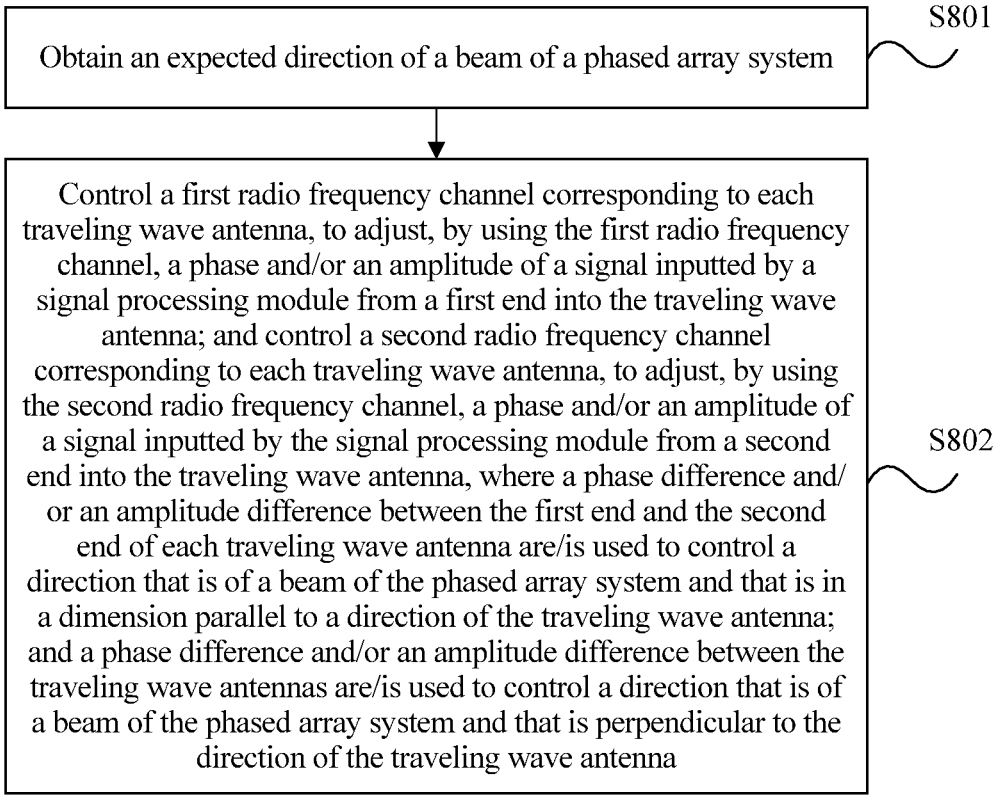
FIG. 8 is a flowchart of Embodiment 2 of a beam scanning method according to an embodiment of the present disclosure.

FIG. 8 is a flowchart of Embodiment 2 of a beam scanning method according to an embodiment of the present disclosure. The method in this embodiment is used for implementing beam scanning of a phased array system. Based on the phased array system shown in FIG. 7, in this phased array system, a second end of each traveling wave antenna connects to a second radio frequency channel, and the second end of each traveling wave antenna connects to the signal processing module by using the corresponding second radio frequency channel.

The method in this embodiment includes the following.

Step S801: Obtain an expected direction of a beam of the phased array system.

Step S802: Control the first radio frequency channel corresponding to each traveling wave antenna, to adjust, by using the first radio frequency channel, a phase and/or an amplitude of a signal inputted by the signal processing module from the first end into the traveling wave antenna; and control the second radio frequency channel corresponding to each traveling wave antenna, to adjust, by using the second radio frequency channel, a phase and/or an amplitude of a signal inputted by the signal processing module from the second end into the traveling wave antenna, where a phase difference and/or an amplitude difference between the first end and the second end of each traveling wave antenna are/is used to control a direction that is of a beam of the phased array system and that is in a dimension parallel to a direction of the traveling wave antenna; and a phase difference and/or an amplitude difference between the traveling wave antennas are/is used to control a direction that is of a beam of the phased array system and that is perpendicular to the direction of the traveling wave antenna.

In this embodiment, both an angle of the beam that is of the phased array system and that is parallel to the direction of the traveling wave antenna and an angle of the beam that is of the phased array system and that is perpendicular to the direction of the traveling wave antenna are controlled, that is, spatial beam scanning of the phased array system is implemented.

The beam scanning method provided in this embodiment is used to control beam scanning of the phased array system shown in FIG. 4. A specific scanning method is described in the foregoing embodiment in detail, and details are not described herein again. The method in this embodiment may be performed by the beam control module 31 in the embodiment shown in FIG. 4.

Further, in the embodiment shown in FIG. 8, the second radio frequency channel includes a second phase shifter and/or a second variable gain amplifier.

Step S802 includes controlling the second phase shifter corresponding to each traveling wave antenna, to adjust, by using the second phase shifter, the phase and/or the amplitude of the signal inputted by the signal processing module from the second end into the traveling wave antenna, so that the beam of the phased array system points to an expected direction in the dimension parallel to the direction of the traveling wave antenna, and/or controlling the second variable gain amplifier corresponding to each traveling wave antenna, to adjust, by using the second variable gain amplifier, the phase and/or the amplitude of the signal inputted by the signal processing module from the second end into the traveling wave antenna, so that the beam of the phased array system points to the expected direction in the dimension parallel to the direction of the traveling wave antenna.

Further, in the embodiment shown in FIG. 8, the method further includes controlling the first radio frequency channel and the second radio frequency channel corresponding to each traveling wave antenna, to adjust, by using the first radio frequency channel, the phase and/or the amplitude of the signal inputted by the signal processing module from the first end into the traveling wave antenna, and to adjust, by using the second radio frequency channel, the phase and/or the amplitude of the signal inputted by the signal processing module from the second end into the traveling wave antenna, so that the beam of the phased array system points to an expected direction in a dimension perpendicular to the direction of the traveling wave antenna, where a phase difference and/or an amplitude difference between the first ends of the traveling wave antennas, or a phase difference and/or an amplitude difference between the second ends of the traveling wave antennas are/is used to control the direction that is of the beam of the phased array system and that is in the dimension perpendicular to the direction of the traveling wave antenna; and a phase difference and/or an amplitude difference between the first end and the second end of each traveling wave antenna are/is used to control the direction that is of the beam of the phased array system and that is in the dimension parallel to the direction of the traveling wave antenna. It should be noted that, both the first radio frequency channel and the second radio frequency channel usually need to be adjusted to control the direction that is of the beam of the phased array system and that is in the dimension perpendicular to the direction of the traveling wave antenna, to maintain a phase difference and/or an amplitude difference of signals inputted from the two ends of each traveling wave antenna in the phased array system, so that the direction that is of the beam and that is in the dimension parallel the direction of the traveling wave antenna is not affected.

Figure 9:
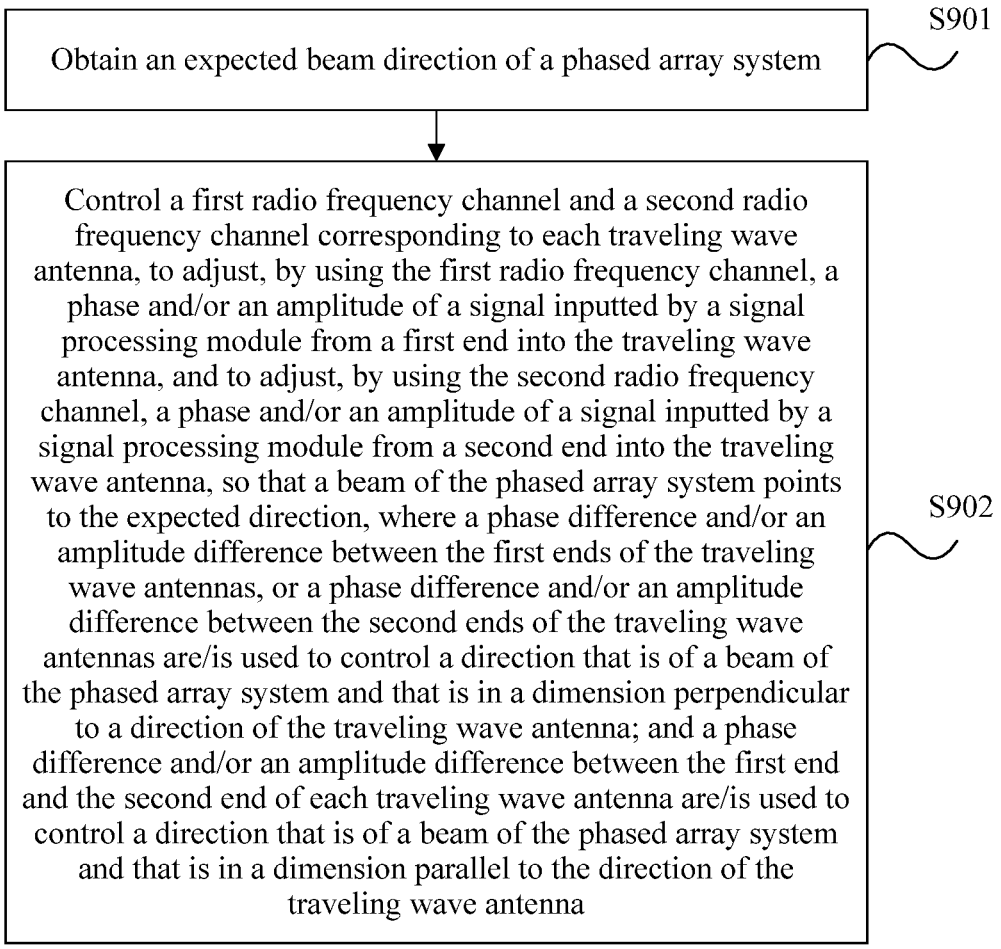
FIG. 9 is a flowchart of Embodiment 3 of a beam scanning method according to an embodiment of the present disclosure.

FIG. 9 is a flowchart of Embodiment 3 of a beam scanning method according to an embodiment of the present disclosure. The method in this embodiment is used for implementing beam scanning of a phased array system. The phased array system includes at least two traveling wave antennas arranged in parallel, and each traveling wave antenna includes at least two antenna units sequentially connected. A first end of each traveling wave antenna connects to a first radio frequency channel, and the first end of each traveling wave antenna connects to a signal processing module of the phased array system by using the corresponding first radio frequency channel. A second end of each traveling wave antenna connects to a second radio frequency channel, and the second end of each traveling wave antenna connects to the signal processing module by using the corresponding second radio frequency channel.

The method in this embodiment includes the following.

Step S901: Obtain an expected direction of a beam of the phased array system.

Step S902: Control the first radio frequency channel and the second radio frequency channel corresponding to each traveling wave antenna, to adjust, by using the first radio frequency channel, a phase and/or an amplitude of a signal inputted by the signal processing module from the first end into the traveling wave antenna, and to adjust, by using the second radio frequency channel, a phase and/or an amplitude of a signal inputted by the signal processing module from the second end into the traveling wave antenna, so that a beam of the phased array system points to the expected direction, where a phase difference and/or an amplitude difference between the first ends of the traveling wave antennas, or a phase difference and/or an amplitude difference between the second ends of the traveling wave antennas are/is used to control a direction that is of a beam of the phased array system and that is in a dimension perpendicular to a direction of the traveling wave antenna, and a phase difference and/or an amplitude difference between the first end and the second end of each traveling wave antenna are/is used to control a direction that is of a beam of the phased array system and that is in a dimension parallel to the direction of the traveling wave antenna.

Finally, it should be noted that the foregoing embodiments are merely intended for describing the technical solutions of the present disclosure, but not for limiting the present disclosure. Although the present disclosure is described in detail with reference to the foregoing embodiments, persons of ordinary skill in the art should understand that they may still make modifications to the technical solutions described in the foregoing embodiments or make equivalent replacements to some or all technical features thereof. Therefore, the protection scope of the present disclosure shall be subject to the protection scope of the claims.

What is claimed is:

1. A phased array system, comprising:

at least two traveling wave antennas arranged in parallel, wherein each traveling wave antenna of the at least two traveling wave antennas comprises a first end and at least two sequentially connected antennas;

at least two first radio frequency channels, wherein the first end of each traveling wave antenna of the at least two traveling wave antennas is coupled to a corresponding first radio frequency channel of the at least two first radio frequency channels;

a signal processor coupled to the first end of each traveling wave antenna of the at least two traveling wave antennas using the corresponding first radio frequency channel of the traveling wave antenna; and a beam controller coupled to each of the at least two first radio frequency channels, wherein the beam controller comprises an arrival estimator configured to determine a direction of arrival, wherein each of the at least two first radio frequency channels is configured to adjust a phase or an amplitude of a first signal inputted by the signal processor into the traveling wave antenna corresponding to the first radio frequency channel from the first end of the traveling wave antenna.

2. The phased array system according to claim 1, wherein each of the at least two first radio frequency channels comprises a first phase shifter configured to adjust the phase of the first signal inputted by the signal processor into the traveling wave antenna corresponding to the first radio frequency channel from the first end of the traveling wave antenna.

3. The phased array system according to claim 1, wherein each of the at least two first radio frequency channels comprises a first variable gain amplifier configured to adjust the amplitude of the first signal inputted by the signal processor into the traveling wave antenna corresponding to the first radio frequency channel from the first end of the traveling wave antenna.

4. The phased array system according to claim 1, wherein each of the at least two first radio frequency channels comprises a first phase shifter and a first variable gain amplifier configured to respectively adjust the phase and the amplitude of the first signal inputted by the signal processor into the traveling wave antenna corresponding to the first radio frequency channel from the first end of the traveling wave antenna.

5. The phased array system according to claim 1, wherein a second end of each of the at least two traveling wave antennas is coupled to a corresponding second radio frequency channel of at least two second radio frequency channels, wherein the second end of each of the at least two traveling wave antennas is coupled to the signal processor using the corresponding second radio frequency channel, and wherein each of the at least two second radio frequency channels is configured to adjust a phase or an amplitude of a second signal inputted by the signal processor into the traveling wave antenna corresponding to the second radio frequency channel from the second end of the traveling wave antenna.

6. The phased array system according to claim 5, wherein each of the at least two second radio frequency channels comprises a second phase shifter configured to adjust the phase of the second signal inputted by the signal processor into the traveling wave antenna corresponding to the second radio frequency channel from the second end of the traveling wave antenna, wherein each of the at least two second radio frequency channels comprises a second variable gain amplifier configured to adjust the amplitude of the second signal inputted by the signal processor into the traveling wave antenna corresponding to the second radio frequency channel from the second end of the traveling wave antenna, or wherein each of the at least two second radio frequency channels comprises the second phase shifter and the second variable gain amplifier configured to adjust the phase and the amplitude of the second signal inputted by the signal processor into the traveling wave antenna corresponding to the second radio frequency channel from the second end of the traveling wave antenna.

7. The phased array system according to claim 1, wherein the beam controller is further configured to adjust the configuration of each of the at least two first radio frequency channels to adjust the phase, the amplitude, or both, of the first signal inputted by the signal processor into the traveling wave antenna corresponding to the first radio frequency channel from the first end of the traveling wave antenna.

8. The phased array system according to claim 7, wherein a second end of each of the at least two traveling wave antennas is coupled to a corresponding second radio frequency channel of at least two second radio frequency channels, wherein the second end of each of the at least two traveling wave antennas is coupled to the signal processor using the corresponding second radio frequency channel, and wherein each of the at least two second radio frequency channels is configured to adjust a phase or an amplitude of a second signal inputted by the signal processor into the traveling wave antenna corresponding to the second radio frequency channel from the second end of the traveling wave antenna, wherein the beam controller is coupled to each of the at least two second radio frequency channels, wherein the beam controller is configured to adjust the configuration of each of the at least two second radio frequency channels to adjust the phase, the amplitude, or both, of the second signal inputted by the signal processor into the traveling wave antenna corresponding to the second radio frequency channel from the second end of the traveling wave antenna.

9. The phased array system according to claim 1, wherein an interval between the at least two antennas of each of the at least two traveling wave antennas is less than an operating wavelength of the phased array system.

10. The phased array system according to claim 1, wherein an interval between the at least two traveling wave antennas is less than an operating wavelength of the phased array system.

11. A beam scanning method for implementing beam scanning of a phased array system, wherein the phased array system comprises at least two traveling wave antennas arranged in parallel, at least two first radio frequency channels, and a signal processor, wherein each of the at least two traveling wave antennas comprises at least two sequentially connected antennas, wherein a first end of each of the at least two traveling wave antennas is coupled to a corresponding first radio frequency channel of the at least two first radio frequency channels, wherein the first end of each of the at least two traveling wave antennas is coupled to the signal processor using the corresponding first radio frequency channel of the traveling wave antenna, wherein an interval between the at least two traveling wave antennas is less than an operating wavelength of the phased array system, and wherein the method comprises:

controlling each of the at least two first radio frequency channels corresponding to each of the at least two traveling wave antennas to adjust a phase, an amplitude, or both, of a first signal inputted by the signal processor into the traveling wave antenna corresponding to the first radio frequency channel from the first end of the traveling wave antenna so that a beam of the phased array system points to an expected direction in a dimension perpendicular to a direction of the traveling wave antenna.

12. The method according to claim 11, wherein controlling each of the at least two first radio frequency channels comprises controlling a first phase shifter corresponding to each of the at least two traveling wave antennas to adjust the phase of the first signal inputted by the signal processor into the traveling wave antenna from the first end of the traveling wave antenna so that the beam of the phased array system points to the expected direction in the dimension perpendicular to the direction of the traveling wave antenna.

13. The method according to claim 11, wherein controlling each of the at least two first radio frequency channels comprises controlling a first variable gain amplifier corresponding to each of the at least two traveling wave antennas to adjust the amplitude of the first signal inputted by the signal processor into the traveling wave antenna from the first end of the traveling wave antenna so that the beam of the phased array system points to the expected direction in the dimension perpendicular to the direction of the traveling wave antenna.

14. The method according to claim 11, wherein controlling each of the at least two first radio frequency channels comprises performing the following so that the beam of the phased array system points to the expected direction in the dimension perpendicular to the direction of the traveling wave antenna:

controlling the first phase shifter corresponding to each of the at least two traveling wave antennas to adjust the phase of the first signal inputted by the signal processor into the traveling wave antenna from the first end of the traveling wave antenna; and controlling the first variable gain amplifier corresponding to each of the at least two traveling wave antennas to adjust the amplitude of the first signal inputted by the signal processor into the traveling wave antenna from the first end of the traveling wave antenna.

15. The method according to claim 11, wherein a second end of each of the at least two traveling wave antennas connects to a corresponding second radio frequency channel of at least two second radio frequency channels, wherein the second end of each of the at least two traveling wave antennas connects to the signal processor using the corresponding second radio frequency channel, wherein the method further comprises controlling each of the at least two second radio frequency channels corresponding to each of the at least two traveling wave antennas to adjust a phase, an amplitude, or both, of a second signal inputted by the signal processor into the traveling wave antenna from the second end of the traveling wave antenna so that the beam of the phased array system points to an expected direction in a dimension parallel to the direction of the traveling wave antenna, and wherein a phase difference, an amplitude difference, or both, between the first end and the second end of each of the at least two traveling wave antennas are used to control the beam of the phased array system to point to the expected direction in the dimension parallel to the direction of the traveling wave antenna.

16. The method according to claim 15, wherein controlling each of the at least two second radio frequency channels comprises controlling a second phase shifter of each of the at least two second radio frequency channels to adjust the phase of the second signal inputted by the signal processor into the traveling wave antenna from the second end of the traveling wave antenna so that the beam of the phased array system points to the expected direction in the dimension parallel to the direction of the traveling wave antenna.

17. The method according to claim 15, wherein controlling each of the at least two second radio frequency channels comprises controlling a second variable gain amplifier of each of the at least two traveling wave antennas to adjust the amplitude of the second signal inputted by the signal processor into the traveling wave antenna from the second end of the traveling wave antenna so that the beam of the phased array system points to the expected direction in the dimension parallel to the direction of the traveling wave antenna.

18. The method according to claim 15, wherein controlling each of the at least two second radio frequency channels comprises:

controlling the second phase shifter of each of the at least two second radio frequency channels to adjust the phase of the second signal inputted by the signal processor into the traveling wave antenna from the second end of the traveling wave antenna; and controlling the second variable gain amplifier of each of the at least two second radio frequency channels to adjust the amplitude of the second signal inputted by the signal processor into the traveling wave antenna from the second end of the traveling wave antenna so that the beam of the phased array system points to the expected direction in the dimension parallel to the direction of the traveling wave antenna.

19. A beam scanning method for implementing beam scanning of a phased array system, wherein the phased array system comprises at least two traveling wave antennas arranged in parallel, at least two first radio frequency channels, at least two second radio frequency channels, and a signal processor, wherein each of the at least two traveling wave antenna comprises at least two sequentially connected antennas, wherein a first end of each of the at least two traveling wave antennas is coupled to a corresponding first radio frequency channel of the at least two first radio frequency channels, wherein the first end of each of the at least two traveling wave antennas is coupled to the signal processor of the phased array system using the corresponding first radio frequency channel of the traveling wave antenna, wherein a second end of each of the at least two traveling wave antennas is coupled to a corresponding second radio frequency channel of the at least two radio frequency channels, wherein the second end of each of the at least two traveling wave antennas is coupled to the signal processor using the corresponding second radio frequency channel of the traveling wave antenna, and wherein the method comprises performing the following so that a beam of the phase array system points to an expected direction:

controlling each of the at least two first radio frequency channels of each of the at least two traveling wave antennas to adjust a phase, an amplitude, or both, of a first signal inputted by the signal processor into the traveling wave antenna from the first end of the traveling wave antenna; and controlling each of the at least two second radio frequency channels of each of the at least two second radio frequency channels to adjust a phase, an amplitude, or both, of a second signal inputted by the signal processor into the traveling wave antenna from the second end of the traveling wave antenna, wherein a phase difference, an amplitude difference, or both, between the first ends of the at least two traveling wave antennas, and a phase difference, an amplitude difference, or both, between the second ends of the at least two traveling wave antennas are used to control a direction of the beam of the phased array system in a dimension perpendicular to a direction of the traveling wave antenna, and wherein a phase difference, an amplitude difference, or both, between the first end and the second end of each of the at least two traveling wave antennas are used to control a direction of the beam of the phased array system in a dimension parallel to the direction of the traveling wave antenna.

20. The beam scanning method of claim 19, wherein an interval between the at least two traveling wave antennas is less than an operating wavelength of the phased array system.

* * * * *